United States Patent [19]

Parashikov et al.

[11] Patent Number: 4,777,817

[45] Date of Patent: Oct. 18, 1988

[54] PRESS TOOL FOR FACE COLLECTOR

[75] Inventors: Peter H. Parashikov; Borislav A. Yonchev; Milko H. Hristov; Alexander K. Alexandrov; Velcho N. Georgiev; Maiya K. Doncheva; Nikola D. Fishekov; Ivan G. Venkov; Chavdar D. Hristov, all of Sofia, Bulgaria

[73] Assignee: D S O "ELPROM", Sofia, Bulgaria

[21] Appl. No.: 48,117

[22] Filed: May 11, 1987

[51] Int. Cl.[4] ..... B21D 22/00

[52] U.S. Cl. ..... 72/352; 72/358

[58] Field of Search ..... 72/352, 729, 358

[56] References Cited

U.S. PATENT DOCUMENTS 4,669,298 6/1987 Kono et al. ..... 72/358

*Primary Examiner*—W. Donald Bray

*Attorney, Agent, or Firm*—Klein & Vibber

[57] ABSTRACT

A press tool comprising a bottom plate onto which there are mounted a die with radial grooves and a profiled ejector inserted into the die and circularly oriented in it so that the grooves of the die and the ejector coincide, and over them, by means of guiding columns and guiding sleeves, there are mounted a top plate with a rigid insert attached to its bottom side, a rest and a punch-holder with radial grooves, in which there are fastened prismatic punches and a central core, and underneath the punch-holder there is provided a punch-guide, fastened to the guiding columns by means of guiding sleeves.

3 Claims, 2 Drawing Sheets

FIG. 1
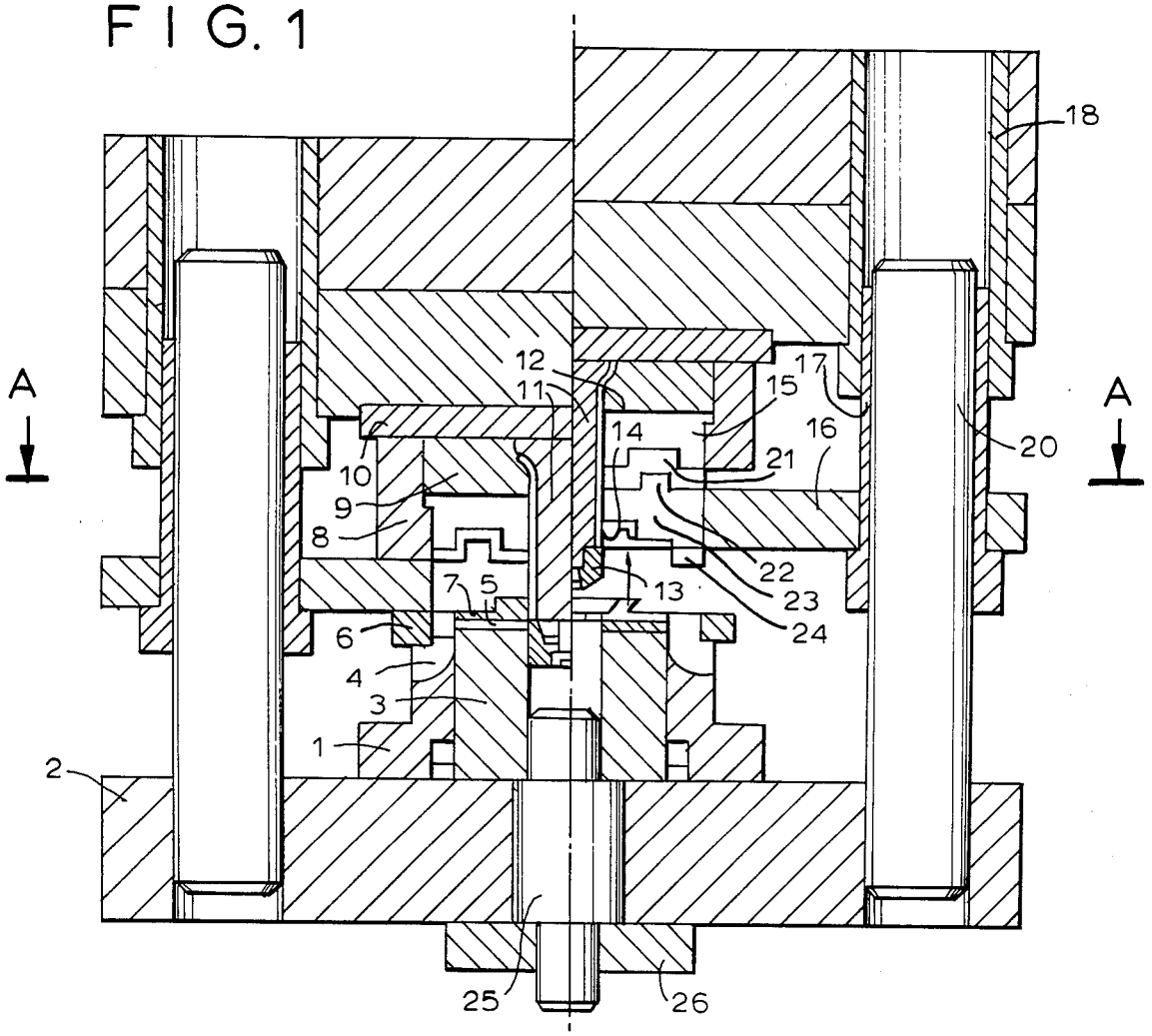
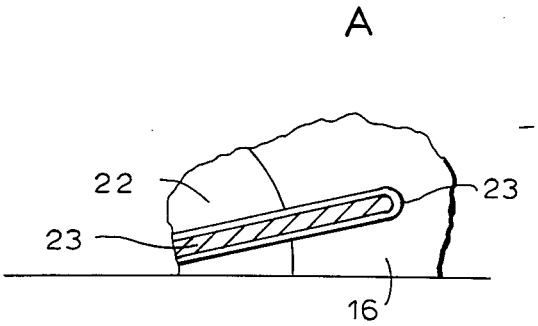
FIG. 2
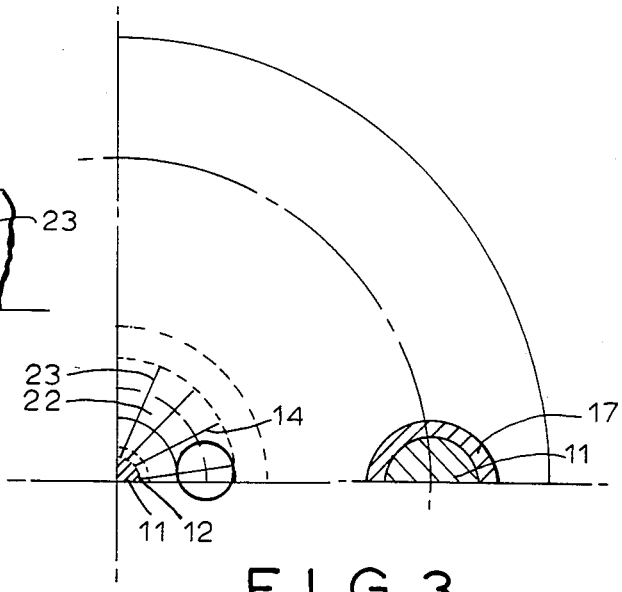
FIG. 3

FIG. 4
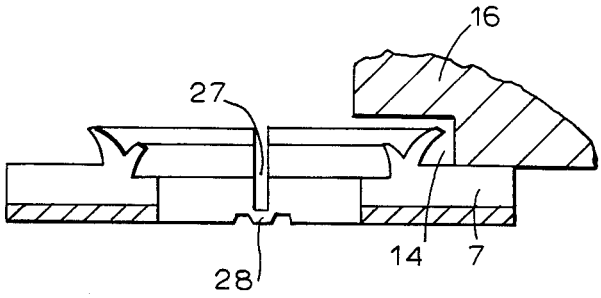
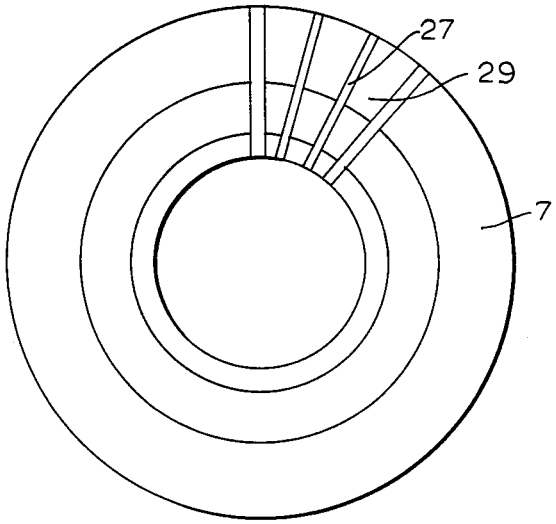
FIG. 5

PRESS TOOL FOR FACE COLLECTOR

BACKGROUND OF THE INVENTION

This invention relates to a press tool for face collector, particularly to a press tool for separating the segments (lamellae) of a blank for the face collector of an electric machine.

A known device for stamping radial grooves in the blank for a face collector for electric machines comprises a base plate, onto which there is mounted a die with ejector with radial grooves, and by means of guiding columns there is arranged over the die the top part of the press tool consisting of a set of wedge punches, which is centered with respect to the axis of the die and is circularly oriented with respect to the radial grooves of the ejector, so that to each punch corresponds one groove. See, Marziniak Z., "Cold Forming of Wedge-Shaped Workpieces".- Proc. 1st Int. Conf. Rotary Metalwork.Proces., London, 1979, Kompstene 1979, 137–146.

The drawbacks of this known device are the impossibility of obtaining parallel walls of the radial grooves of the collector blank and a preset distance between the segments, the necessity of a great pressing force, and a reduced repair suitability of the finished face collector because of the enlargement of the distance between the segments at repeated machining by turning.

It is, therefore, a general object of the invention to develop a press tool for the blank of a face collector for electric machines, which makes it possible to press in the blank for the face collector radial grooves with parallel walls and preset distance between the segments, which requires less pressing force and which results in increased accuracy of the sizes of the processed blank.

SUMMARY OF THE INVENTION

This object is achieved by means of a press tool comprising a bottom plate onto which there are mounted a die with radial grooves and a profiled ejector inserted into the die and circularly oriented in it so that the grooves of the die and the ejector coincide. Over the die and ejector, by means of guiding columns and guiding sleeves, there are mounted a top plate with a rigid insert attached to its bottom side, a rest and a punch-holder with radial grooves, in which there are fastened prismatic punches and a central core. Underneath the punch-holder, there is provided a punch-guide, fastened to the guiding columns by means of guiding sleeves.

According to the invention, the die is provided with radial grooves which are open in the bottom and top end are are closed along the outer diameter by means of a banding ring. The profiled ejector centered in the die is disposed at a lower level than the face of the die and forms together with the die, a stamping cavity. Over the die there is positioned a punch-holder, which is circularly oriented by means of guiding columns, in which there are inserted a rest, a rigid insert and a central core with stiffening grooves. In the bottom portion of the central core there is mounted a limiting sleeve. Between the punch-holder and the die, there is fastened the punch-guide, and between it and the punch-holder there are provided a telescopically shaped circular tooth and a circular groove. The prismatic punches are fastened to grooves in the punch-holder, the central core and the rest, pass through the grooves of the punch-holder and their guides enter the radial grooves of the die. The punches are circularily oriented and are in position opposite to the radial grooves of the profiled ejector.

The advantages of the invention lie in the ability to stamp with the press tool, in a blank face collector, radial grooves with parallel walls and a preset distance between the segments, using a reduced pressing force and resulting in an increased size accuracy of the produced blank and improved repair suitability of the finished collector.

BRIEF DESCRIPTION OF THE DRAWINGS

With these and other objects in view, which will become apparent in the following detailed description, the present invention, which is shown by example only, will be clearly understood in connection with the accompanying drawing, in which:

FIG. 1 is a vertical cross-sectional view of the press tool for face collector, the left side showing the working position, and the right side showing the starting position;

FIG. 2 is a partial cross-sectional view through the prismatic punches and a column of the punch-holder;

FIG. 3 is a partial cross-sectional view along line A—A of FIG. 1 of one quarter of the tool;

FIG. 4 is a diametrical sectional view of a blank for a face collector; and

FIG. 5 is a top view of a blank for a face collector.

DESCRIPTION OF THE PREFERRED EMBODIMENT

The press tool for face collector comprises a die 1 with a profiled ejector 3, centrally disposed and circularly oriented in the die. The ejector 3 is provided with ejector grooves 5. The die and the ejector are mounted onto a bottom plate 2, in the centre of which an ejector pin 25 is fastened by means of a limiter 26.

The die 1 is provided with radial grooves 4, which are closed along its periphery by means of a banding ring 6.

Guiding columns 28 are mounted on bottom plate 2 and a top plate 19 is movably mounted on the guiding columns 28 preferably by limiting sleeves 18.

The blank 7 for the face collector (not shown) is inserted in the die 1. Over the blank 7, there is disposed a circularly oriented punch holder 8 which is attached to a rigid insert 10 of the top plate 19. The punch holder 8 is provided with guide grooves 15 and a circular groove 21. In the punch holder 8, there are mounted a rest 9 and a central core 11. In the central core 11, there are machined stiffening grooves 12, and in the bottom portion of the central core 11, there is preferably disposed a limiting sleeve 13.

A punch guide 16 is movably mounted on said columns 28 preferably by guiding sleeves 17 and is disposed between said die 1 and said punch holder 8. The punch guide 16 is provided with guiding grooves 14 and a circular tooth 22.

Prismatic punches 23 are positioned in the fixing grooves 15 of the pinch holder 8 and in the stiffening grooves 12 of the central core 11 and in the guiding grooves 14 of the punch guide 16. The punches 23 are preferably provided with guides 24 which will enter into the radial grooves 4 of the die 1 when the press is activated.

The circular tooth 22 of the punch guide 16 similarly enters into the circular groove 21 of the punch holder 8 when the press is activated.

Also when the press is activated, the connecting bridges 28 of the blank for the face collector 7 enter into the ejector grooves 5 of the profiled ejector 3.

Opposite to the connecting bridges 28, there are formed the intersegmental grooves 27, while between the intersegmental grooves 27 there are formed the collector segments 29.

The operation of the press tool for face collector, according to the present invention, is as follows:

When the top plate 19 moves towards the bottom plate 2, the guides 24 of the punches 23 enter the radial grooves 4 of the die 1. Then, the prismatic punches 23 penetrate into the blank for face collector 7 until the punch-guide 16 is limited by the die 1, thus forming the intersegmental grooves 27 and the connecting bridges 28 between the collector segments 29 on the blank 7. In the beginning of the stamping, the circular tooth 22 of the punch-guide 16 increases the longitudinal stability of the prismatic punches 23. During the back stroke, the ejector pin 25 and the profiled ejector 3 ejects the blank for the face collector 7 out of the die 1.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. A press tool for a face collector, particularly for separating segments of a blank for the face collector of a electric machine, comprising a bottom plate onto which there are mounted a die and a profiled ejector inserted into the die;

a plurality of guiding columns mounted on said bottom plate, said guiding columns being provided with guiding sleeves;

a top plate movably mounted on said guiding columns, said top plate being provided with a rigid insert in its bottom part;

said rigid insert being provided with a rest and a punch holder;

a plurality of prismatic punches mounted in said punch holder and surrounding a central core;

said central core being provided with a plurality of longitudinal stiffining grooves;

a punch guide, disposed below the punch holder and movably mounted on said guiding columns;

said punch holder being provided with a plurality of guide grooves, said punches being disposed in said guide grooves and in said longitudinal grooves;

said die being provided with a plurality of radial grooves facing said punches.

2. A press tool for a face collector, particularly for separating segments of a blank for the face collector of an electric machine, comprising a bottom place onto which there are mounted a die and a profiled ejector inserted into the die;

a plurality of guiding columns mounted on said bottom plate, said guiding columns being provided with guiding sleeves;

a top plate movably mounted on said guiding columns, said top plate being provided with a rigid insert in its bottom part;

said rigid insert being provided with a rest and a punch holder;

said punch holder being provided with a circular groove;

a plurality of prismatic punches mounted in said punch holder and surrounding a central core;

said prismatic punches being provided with guides;

said central core being provided with a plurality of longitudinal stiffining grooves and a limiting sleeve in its bottom portion;

a punch guide, disposed below the punch holder and movably mounted on said guiding columns, said punch guide being provided with a plurality of guiding grooves and a circular tooth;

said punch holder being provided with a plurality of guide grooves, said punches being disposed in said guide grooves, in said longitudinal grooves and in said guiding grooves;

said die being provided with a plurality of radial grooves facing said punches, said radial grooves being open at their bottoms and closed along their external cylindrical portions by a banding ring;

said profiled ejector being centrally located beneath said die and forming with said die a stamping cavity, said punch holder being disposed above said cavity.

3. A press tool for face collector as claimed in claim 2, wherein the profiled ejector is provided in its top face portion with ejector grooves, in which there are formed connecting bridges of the blank for the face collector.

* * * * *